US006348509B1

(12) United States Patent
Reeve

(10) Patent No.: US 6,348,509 B1
(45) Date of Patent: Feb. 19, 2002

(54) METHOD OF INHIBITING THE FORMATION OF OIL AND WATER EMULSIONS

(75) Inventor: Paul Francis David Reeve, Valbonne (FR)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/377,478

(22) Filed: Aug. 19, 1999

(30) Foreign Application Priority Data

Sep. 7, 1998 (FR) ..... 98-11157

(51) Int. Cl.[7] ..... B01D 17/05

(52) U.S. Cl. ..... 516/180; 210/708; 507/921; 516/161; 516/185

(58) Field of Search ..... 516/161, 180, 516/185; 507/921; 210/708

(56) References Cited

U.S. PATENT DOCUMENTS

| | | | | | |
|---|---|---|---|---|---|
| 3,528,928 | A | * | 9/1970 | Rushton | 516/180 X |
| 3,557,017 | A | * | 1/1971 | Mange et al. | 516/180 X |
| 4,321,148 | A | * | 3/1982 | McCoy et al. | 210/708 |
| 4,626,379 | A | | 12/1986 | Buriks et al. | 525/529 X |
| 4,741,835 | A | * | 5/1988 | Jacques et al. | 210/708 |
| 4,968,449 | A | | 11/1990 | Stephenson | |
| 5,021,167 | A | * | 6/1991 | Braden et al. | 516/161 X |
| 5,156,767 | A | * | 10/1992 | Fitzgerald et al. | 210/708 X |
| 5,298,079 | A | | 3/1994 | Guymon | 134/16 |
| 5,407,585 | A | | 4/1995 | Taylor et al. | 210/708 |
| 5,552,498 | A | | 9/1996 | Braden | 210/708 X |
| 5,759,409 | A | | 6/1998 | Knauf et al. | 210/708 |
| 5,921,912 | A | * | 7/1999 | Hart et al. | 516/180 X |

FOREIGN PATENT DOCUMENTS

| | | |
|---|---|---|
| CA | 1010740 | 5/1977 |
| GB | 2148931 | 6/1985 |

* cited by examiner

*Primary Examiner*—Richard D. Lovering

(57) ABSTRACT

The invention provides a method of inhibiting the formation of stable water in oil emulsions which are typically formed during the production of crude oil. The method involves the addition of one or more amphiphilic compounds which may comprise a hydrophilic backbone and hydrophobic groups attached thereto. The hydrophilic backbone may comprise polymerised units of one or more monomer compounds which may be selected from one or more of alkylene oxide, (meth)acrylic acid, acrylate, urethane, cellulose and vinyl alcohol. The hydrophobic groups may be attached to the hydrophilic backbone in one or more of the following positions: at one or more of the ends of the backbone, either regularly or randomly spaced along the length of the backbone, and as linking groups to link two or more portions of the hydrophilic backbone together.

10 Claims, No Drawings

METHOD OF INHIBITING THE FORMATION OF OIL AND WATER EMULSIONS

This is a nonprovisional application of prior pending French provisional application Ser. No. 98-11157,448 filed Sep. 7, 1998.

The present invention relates to a method of inhibiting the formation of emulsions of oil and water; such emulsions form, for example, during the production of crude oil.

The initial recovery of oil from a new oil well often gives almost pure crude oil, however, it is not long before the composition is extracted as a water-in-oil emulsion. This is due to either the presence of formation water in the oil reservoirs, or the use of enhanced oil recovery processes (or both). As oilwell reservoir pressures drop, and recovery rates fall, a commonly used technique within the industry to boost production is water injection. In the case of oilfields situated under or by the sea, sea water is used for this process. The presence of both types of water leads sooner or later to the recovery of a mixture of oil and water at the well head. Obviously, it is not cost effective to store and transport high water mixtures, hence the water must be separated off or at least reduced to an acceptable concentration. Unfortunately, depending on the nature of the crude oil, this poses a difficult challenge. Crude oil is very variable in composition, depending upon its source. Certain of the components present in crude oil act as natural emulsifiers, and consequently tend to form emulsions from the mixture of oil and water obtained from oil reservoirs under the previously mentioned circumstances. In particular, asphaltenes are good naturally occurring emulsifiers. If the concentration of asphaltenes and other emulsifiers is low, then often, the emulsions formed are naturally unstable. If the concentration is high, however, then it is possible to form very stable emulsions which can be difficult to separate. Mechanical recovery procedures are known, but typically, oil demulsifiers are added to break the emulsion after it has formed. Because the composition and nature of the crude oil emulsions varies quite considerably depending on the source, many different oil demulsifiers are currently in use worldwide; this multiplicity of demulsifiers causes difficulty since care must be taken to select the appropriate demulsifier for each oil field to ensure that it has utility.

Many patent documents describe the wide range of water-in-oil demulsifiers available, for example, U.S. Pat. No. 5,407,585 discloses water-in-oil demulsifying agents comprising an adduct of (a) a poly ($C_3$ –$C_4$ alkylene) glycol of molecular weight 6000–26000 and (b) a compound selected from one or more of ethylene oxide and diglycidyl ether. U.S. Pat. No. 5,552,498 teaches oil-in-water emulsion breakers particularly for use with industrial waste water comprising an alkaline aqueous mixture of acrylic acid, an amine acrylate, sodium formate and 2,2$^{I}$-azobis(2-amidinopropane) dihydrochloride. U.S. Pat. No. 4,968,449 describes an alkoxylated vinyl polymer demulsifier for crude oil emulsions comprising hydrophobic vinyl monomer(s) and hydrophilic vinyl monomer(s) reacted with alkylene oxide. U.S. Pat. No. 4,626,379 describes demulsifier compositions comprising partially cross-linked reaction products of (a) at least two polyoxyalkylene oxide copolymers and (b) a vinyl monomer. Canadian patent document 1010740 teaches compositions for breaking crude oil emulsions, made by reacting (a) polyoxyalkylene alcohol with (b) maleic anhydride glycidyl acrylate, allyl glycidyl ether and reacting the resultant product with an O- or N-containing vinyl addition monomer. Finally United Kingdom patent 2148931 discloses demulsifiers which are copolymers of allyl or (meth)allyl polyoxyethylene ether, vinyl ester and optionally a (meth)acrylate ester.

However, not only is it necessary to find a demulsifier which has utility to demulsify emulsions with the particular crude oil source, but for those crude oils having a high content of naturally occurring emulsifier agents, in particular, high asphaltene levels, there is a further problem in that many of the commonly used demulsifiers are ineffective, or show reduced efficacy with such emulsions. In certain cases, the emulsions are actually stabilised by the addition of demulsifiers and this makes it extremely difficult, if not impossible, to extract the water from them. Typically, the crude oil only needs to contain about 5% or more of asphaltene to give rise to stable emulsions which do not respond well to demulsification.

Recently, it has been proposed to control the formation of emulsions by adding emulsion inhibitors to the oil and water mix prior to the formation of a stable emulsion. This could be, for example, near the base of the collector well, or at some other convenient point, such that the inhibitor is mixed with the fluids before the mix is sheared by passing through pumps, valves etc. creating a stable dispersed water in oil system. The crucial difference between demulsifiers and emulsion inhibitors is that a demulsifier is added to the emulsion after it has formed whereas the emulsion inhibitor is added before a stable emulsion is formed and acts to prevent the formation of a stable water in oil dispersion.

A procedure for testing and developing water-in-crude oil emulsion inhibitors is detailed in a paper given by Dalmazzone, Bocard and Ballerini at the Proceedings of the 18$^{th}$ Arctic and Marine Oil Spill Program (AMOP) Technical Seminar dated Jun. 14–16, 1995. Although this disclosure refers to "surfactants" as suitable emulsion inhibitors, no other details are given.

The aim of the present invention is to provide a method of preventing the formation of stable water-in-oil emulsions. In particular, the method is designed to be effective at inhibiting the formation of stable emulsions such as those formed when the oil has a high asphaltene content.

Accordingly, the present invention provides a method of inhibiting the formation of stable water-in-oil emulsions comprising adding to either water or oil or both, prior to the formation of a stable water-in-oil emulsion, one or more amphiphilic compounds.

The term "amphiphilic compounds" refers to compounds which contain both polar water soluble and hydrophobic water insoluble groups.

Preferably, the amphiphilic compounds comprise a hydrophilic polymeric backbone with one of more hydrophobic groups attached thereto.

The hydrophobic groups are located on the hydrophilic polymeric backbone at one or more of the following positions, a) at one or more of the ends of the backbone, for example as shown by formula (I) below, b) regularly or randomly paced along the length of the backbone, for example as shown by formulae (II) and (III) respectively below, and c) as linking groups to link together two or more portions of the hydrophilic backbone, as shown by formula (IV) below.

(I)

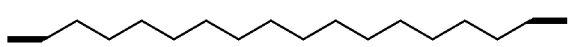

-continued (II)

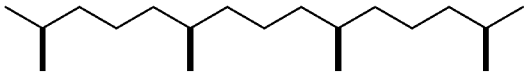

(III)

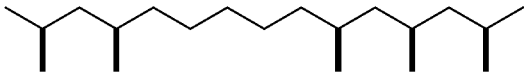

(IV)

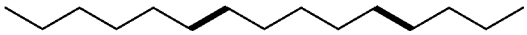

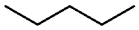

Polymer backbone

Hydrophobic moiety

Preferably the hydrophilic polymer backbone comprises polymerised units of one or more of monomers selected from alkylene oxide, (meth)acrylic acid, (meth)acrylate, urethane, cellulose and vinyl alcohol. When an alkylene oxide is used it is preferably a $C_2$–$C_3$ containing monomer; ethylene oxide is particularly preferred. Hydrophilic backbones containing urethane are especially efficacious.

The hydrophobic moiety may be selected from at least one $C_4$–$C_{30}$ alkyl, phenyl or alkylphenyl groups, preferably $C_6$–$C_{22}$ alkyl groups are used and $C_6$–$C_{18}$ alkyl groups are especially preferred.

The degree of emulsion inhibition activity for the amphiphilic compounds used in the method of the present invention appears to be influenced by its weight average molecular weight. Effective inhibition activity is obtained when the weight average molecular weight is in the range 28,100 to 350,000. In particular, when the backbone comprises urethane units, particularly good activity is obtained when the amphiphilic compounds have a weight average molecular weight of at least 28,200; a weight average molecular weight of from 28,200 to 100,000 is particularly preferred. When the backbone comprises acrylic units the weight average molecular weight is preferably below 350,000; when it is above this level, it becomes increasingly more difficult to disperse the amphiphilic compounds in the crude oil, thus causing inhibition activity to decrease.

Highly preferred are amphiphilic compounds which separate a significant proportion of a stable oil-in-water emulsion after 10 minutes or less following agitation of a mixture of the oil and water.

The amphiphilic compounds may be polymeric compounds which may be prepared, for example, by reacting polyglycols with alcohols in the presence of diisocyanates. The diisocyanates serve to link the polyglycols together, as well as to link the alcohols to the growing polyglycol chains. Alternatively they may be prepared by simply linking hydrophobes to a longer chain polyalkyleneoxide to give a telechelic structure. It is also possible to produce polymers suitable for the invention by for example, emulsion or solution polymerisation.

The amphiphilic compounds may be used alone or in combination with one or more solvents such as xylene, glycols, water and lower alcohols such as isopropanol, to produce a fluid which will disperse in the crude oil and/or the water. Preferably the solvent comprises mixtures of glycols and water, or lower alcohols and water. Surfactants such as alkoxylated nonionics can also produce fluid dispersible blends with the amphiphilic compounds. The amphiphilic compounds may also be used in combination with demulsifying agents.

The present invention will now be described with reference to the following Examples.

Evaluation of Emulsion Inhibition

All of the following tests were conducted on oil and water mixtures which have been found to be very difficult to demulsify using the typical demulsification compounds and techniques. The crude oil used had a relatively high (8%) asphaltene content and these high molecular weight polycyclic aromatic compounds are well known to form stable emulsions in crude oil.

Samples of the amphiphilic compounds detailed in Table 1 below were used as a 5% solution in a solvent and were tested as follows: 50 $\mu l$ of the aqueous amphiphilic compound solution was added to a mixture of 30ml of crude oil and dispersed in the oil prior to the addition of 20ml of water. The total content of amphiphilic compound being 83ppm, based on the crude oil. The resulting water, oil, amphiphilic compound mixture was shaken vigorously 20 times in Experiment 1 and 50 times in Experiment 2; after agitation the samples were allowed to stand at 50° C. The purpose of increasing the amount of agitation was to ensure that the water-in-oil emulsion was developed as fully as possible. Table 2, below, details the percentage separation of the oil-in-water emulsion over time; the results were obtained by measuring the volume of water which separated from the emulsion over time, a graduated measuring vessel was used for this purpose; a figure of 100% would indicate total water-in-oil separation. The solvents used to dissolve the amphiphilic compound were either xylene, isopropanol or water and, as confirmed by the results presented in Table 2 below, these solvents have negligible affect on the percentage separation of the water in oil emulsions over time.

TABLE 1

Details of Composition of the Compounds Tested

| Compound Tested | Description | Weight Ave. Mol. Weight |
|---|---|---|
| 1 | Xylene (Control solvent) | — |
| 2 | Isopropanol (Control solvent) | — |
| 3 (Exp.) | Polyurethane with $C_{10}$ hydrophobic groups | 60,000 |
| 4 (Exp.) | Polyurethane with $C_{10}$ hydrophobic groups | 28,450 |
| 5 (Exp.) | Acrylic backbone with $C_{12}$ containing hydrophobic groups links to the backbone via ethoxyester group | ≅250,000 |
| 6 (Comp.) | Hindered Primary Amine. Commercial material "PRIMENE" | ≅270 |
| 7 (Exp.) | Polyurethane with $C_{18}$ hydrophobic groups | 35,000 |
| 8 (Exp.) | Polyurethane backbone with a single $C_{10}$ hydrophobic group | 42,600 |
| 9 (Exp.) | Polyurethane backbone with two $C_{10}$ hydrophobic groups | 42,250 |
| 10 (Exp.) | Polyurethane backbone with $C_6$ hydrophobic groups | 41,150 |
| 11 (Exp.) | Polyurethane backbone with $C_{10}$ hydrophobic groups | 50,350 |
| 12 (Exp.) | Polyurethane backbone with $C_{10}$ hydrophobic groups | 28,100 |
| 13 (Exp.) | Polyurethane with $C_6$ hydrophobic groups | 35,000 |
| 14 (Exp.) | Acrylic backbone with $C_{12}$ containing hydrophobic groups links to the backbone via ethoxyester group | ≅325,000 |
| 15 (Comp.) | Acrylic backbone with $C_{12}$ containing hydrophobic groups links to the backbone via ethoxyester group | ≅755,000 |
| 16 (Comp.) | Polyethylene oxide without any hydrophobic groups | ≅200,000 |

The "Exp." samples are experimental samples used in the method according to the present invention; the "Comp."

samples are comparative examples which are outside the scope of the present invention.

TABLE 3

Results Showing the Percentage Separation of the Water in Oil Emulsion Over Time.

| Sample | 3 Mins | 10 Mins | 30 Mins | 2 Hrs | 8 Hrs |
|---|---|---|---|---|---|
| Experiment 1 (Shaking 20×) | | | | | |
| 1 | 0 | 0 | Trace | 13 | 25 |
| 2 | 0 | 0 | 4 | 8 | 25 |
| 3 (exp.) | 63 | 71 | 83 | 92 | 92 |
| 4 (exp.) | 75 | 83 | 88 | 92 | 96 |
| 5 (exp.) | 0 | 0 | Trace | 38 | 75 |
| 6 (comp.) | 0 | Trace | 8 | 42 | 67 |
| 7 (exp.) | 63 | 71 | 83 | 92 | 96 |
| 8 (exp.) | 79 | 88 | 92 | 96 | 96 |
| Blank (control) | 0 | 0 | Trace | 8 | 21 |
| Experiment 2 (Shaking 50×) | | | | | |
| 8 (exp.) | 50 | 71 | 79 | 88 | 96 |
| 9 (exp.) | 63 | 75 | 83 | 88 | 92 |
| 10 (exp.) | 71 | 79 | 88 | 92 | 92 |
| 11 (exp.) | 54 | 71 | 71 | 88 | 92 |
| 12 (exp.) | 0 | 0 | 0 | 21 | 50 |
| 13 (exp.) | 75 | 79 | 83 | 100 | 100 |
| 14 (exp.) | 0 | 0 | 0 | Trace | 5 |
| 15 (Comp.) | 0 | 0 | 0 | 0 | Trace |
| 16 (Comp.) | 0 | 0 | 0 | 0 | Trace |
| Blank (control) | 0 | 0 | 0 | 0 | Trace |

As the above results show, a blank sample, i.e. one which contains no amphiphilic compound, produces a very stable emulsion after shaking 50 times. This mixture only just showed signed of separating after 8 hours. For the experimental compounds according to the present invention, 3, 4, and 7–11 and 13, an extremely fast separation of the oil droplets from the water is achieved and a major percentage of the separation occurs after only 3 minutes; by 8 hours the separation is virtually completed. Compounds 5, 12 and 14 are also according to the present invention. These materials showed lower inhibition effectiveness compared with the other experimental compounds, nevertheless, the results obtained do provide a significant practical benefit as compared with the control samples. Compound 6 is currently sold under the trade mark PRIMENE by Rohm and Haas Company as a demulsifier for water in oil emulsions. It has a surfactant-like structure and since the prior art inhibitors are described to be surfactants, it is perhaps not surprising that this compound has some inhibition activity.

I claim:

1. A method of inhibiting formation of stable water-in-oil emulsions comprising adding at least one amphiphilic polymer to a mixture of water and oil prior to formation of a stable water-in oil emulsion; wherein the amphiphilic polymer is a polymer having one or more hydrophobic groups attached to a hydrophilic backbone consisting of polymerized monomer units of urethane.

2. The method according to claim 1, wherein the one or more hydrophobic groups are attached to a polyurethane backbone in one or more of the following positions selected from the group consisting of at or near ends of the backbone, at regular intervals along the backbone length, at random intervals along the length of the backbone and linked together with two or more backbones via the hydrophobic groups.

3. The method according to claim 2, wherein the hydrophobic groups are selected from the group consisting of alkyl groups having from 4 to 30 carbon atoms, phenyl groups having from 4 to 30 carbon atoms, alkyl-substituted phenyl groups having from 4 to 30 carbon atoms and combinations thereof.

4. The method according to claim 1, the amphiphilic polymer having a weight average molecular weight ranging from 28,100 to 350,000.

5. The method according to claim 1, the amphiphilic polymer having a weight average molecular weight ranging from 28,200 to 100,000.

6. The method according to claim 1, wherein the total level of amphiphilic polymer added is 83 parts per million based on a 30 mL volume of oil.

7. The method according to claim 1, wherein an amphiphilic polymer having a polyurethane backbone and hydrophobic groups having from 6 to 18 carbon atoms separates a stable oil-in-water emulsion following agitation of the emulsion.

8. The method according to claim 1, wherein the amphiphilic polymer is combined with one or more compounds selected from the group consisting of solvents, surfactants, demulsifiers, and combinations thereof, producing a fluid that disperses in to the emulsions.

9. The method according to claim 8, wherein the solvents are selected from the group consisting of xylene, glycols, water, lower alcohols, and combinations thereof.

10. A method of inhibiting formation of stable emulsions of crude oils and water comprising adding at least one amphiphilic polymer having one or more hydrophobic groups containing 6 to 18 carbon atoms attached to a polyurethane backbone prior to formation of the stable emulsions.

* * * * *